United States Patent [19]

Shimazaki

[11] Patent Number: 4,566,402

[45] Date of Patent: Jan. 28, 1986

[54] DEVELOPING APPARATUS

[75] Inventor: Takashi Shimazaki, Kawasaki, Japan

[73] Assignee: Kabushiki Kaisha Toshiba, Kawasaki, Japan

[21] Appl. No.: 665,344

[22] Filed: Oct. 26, 1984

[30] Foreign Application Priority Data

Oct. 28, 1983 [JP] Japan ..... 58-200763

[51] Int. Cl.[4] ..... G03G 15/08

[52] U.S. Cl. ..... 118/653

[58] Field of Search ..... 118/657, 658, 653

[56] References Cited

U.S. PATENT DOCUMENTS 3,232,190 2/1966 Willmott et al. .
3,866,574 2/1975 Hardennrook et al. .
4,232,628 11/1980 Shelffo .
4,337,724 7/1982 Hosono et al. ..... 118/658 X

FOREIGN PATENT DOCUMENTS 0137360 10/1981 Japan ..... 118/658

*Primary Examiner*—Bernard D. Pianalto
*Attorney, Agent, or Firm*—Cushman, Darby & Cushman

[57] ABSTRACT

A developing apparatus is provided with a developing roller for carrying a toner thereon in a housing. An elastic blade is pressed against the surface of the developing roller in one direction to apply the toner, so that the toner is applied to the surface of the developing roller by the elastic blade to form a toner layer on the surface of the developing roller. The toner layer is opposed to a photosensitive drum at a predetermined space to deposit the toner on a latent image on the photosensitive drum. The elastic blade comprises a fixed plate and a contact plate which are fixed to each other at one end thereof. The other end of the fixed plate is fixed to the housing. A central portion of the contact plate is pressed against the surface of the developing roller.

8 Claims, 4 Drawing Figures

DEVELOPING APPARATUS

BACKGROUND OF THE INVENTION

The present invention relates to a developing apparatus which develops an electrostatic latent image formed on an image bearing member by using a developing agent. More particularly, the invention relates to a developing apparatus which comprises a developing agent carrier with an elastic member being urged against a surface, thereof. A developing agent layer is then formed on the surface of the developing agent carrier through the elastic member upon the movement of the developing agent carrier, and the developing agent layer is, opposed to the image carrier. The latent image is thereby developed.

In conventional developing apparatuses which use a one-component developing agent, in order to form a developing agent layer on a developing agent carrier, an elastic blade formed of urethane rubber or stainless steel is pressed against a surface of the developing agent carrier. For example, when a nonmagnetic developing agent is used, the developing agent is charged by friction between the elastic blade and the developing agent carrier. Therefore, in order to form a good visible image, the developing agent must be uniformly charged at a desired potential and the contact width between the elastic blade and the developing agent carrier must be widely set.

However, in the conventional developing apparatuses, it is very difficult to set the contact width between the elastic blade and the developing agent carrier at a desired value. For example, if a central portion of the elastic blade, excluding its edge portions, is brought into firm surface contact with the developing agent carrier, the contact width thereof can be increased to some extent. However, in this case, the contact pressure between the elastic blade and the developing agent carrier becomes excessive. Particularly, when a cylindrical developing agent carrier is used and the diameter thereof is decreased, it becomes still more difficult to set the contact width between the elastic blade and the developing agent carrier to a large width.

SUMMARY OF THE INVENTION

The present invention has been made in consideration of the above situation, and has as its object to provide a developing apparatus in which, even when a cylindrical developing agent carrier having a small diameter is used, a contact width between an elastic blade and the developing agent carrier can be widely set, and a good visible image can be formed by charging a developing agent carrier at a desired potential by friction.

In order to achieve the above object according to the present invention, an elastic blade comprises a fixed plate and a contact plate which are fixed to each other at one end thereof, and the contact plate is urged against a developing agent carrier.

DETAILED DESCRIPTION OF THE PREFERRED EMBODIMENTS

One embodiment of a developing apparatus according to the present invention applied to an image forming apparatus will now be described in detail with reference to the accompanying drawings of FIGS. 1 to 4.

Figure 1:
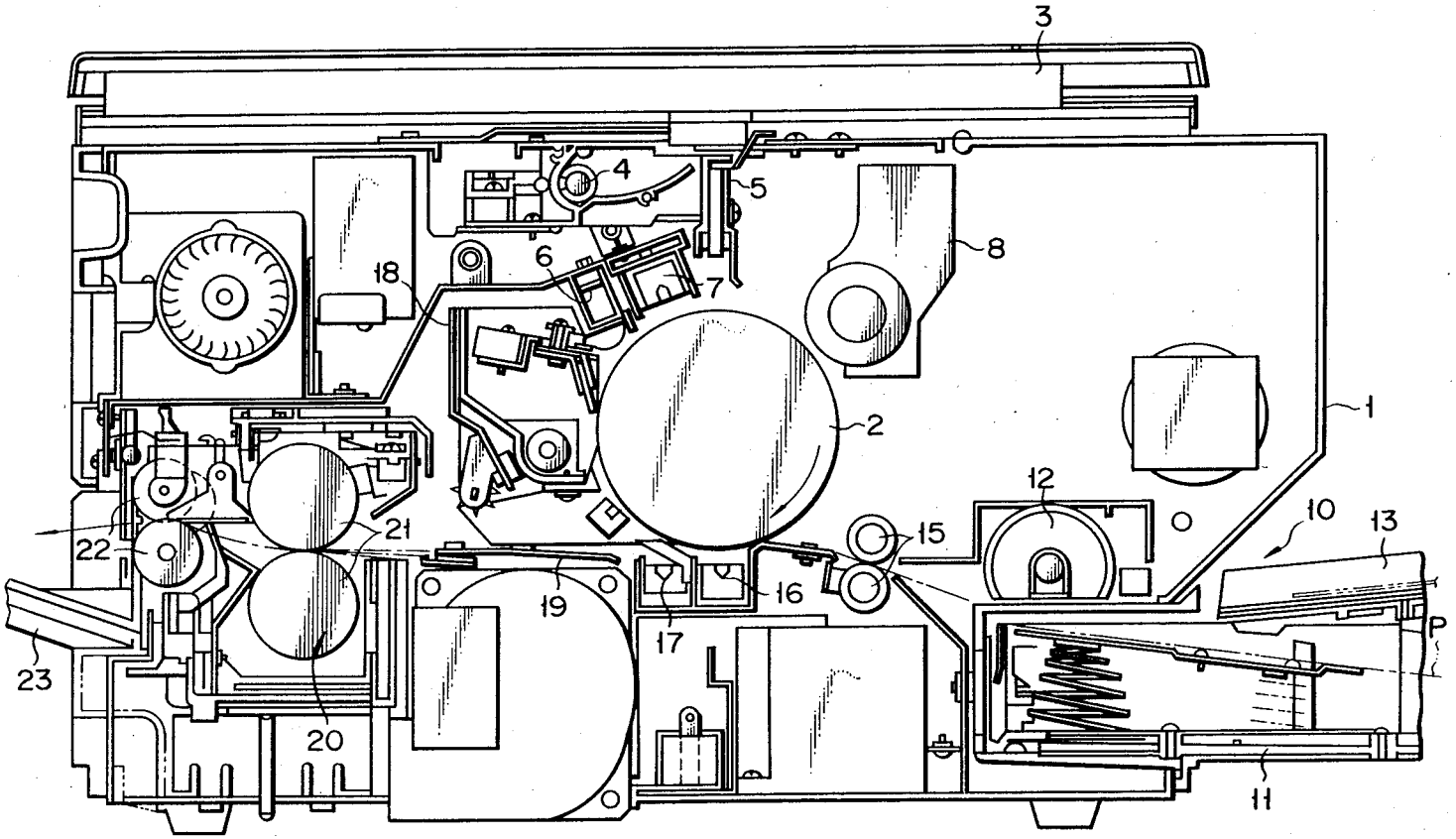
FIG. 1 is a sectional view schematically showing a copying machine using a developing apparatus according to the present invention.

First, the image forming apparatus, e.g., a copying machine, using the developing apparatus of the invention will be described. FIG. 1 is a sectional view schematically showing the copying machine. In FIG. 1, numeral 1 designates a housing of the copying machine. Rotatably disposed in the central portion of the housing 1 is an image carrier, e.g., a photoconductive drum 2 made of selenium, on the surface of which is formed an electrostatic latent image. The photoconductive drum 2 is surrounded by a lamp 4 and a convergent light transmitting member 5 (e.g. optical scanner) for optically scanning an original paper put on a horizontally reciprocating original table 3 and for forming an electrostatic latent image corresponding to an image of the original paper, on the surface of the photoconductive drum 2. A discharge lamp 6 is provided for de-electrifying the surface of the photoconductive drum 2 before the formation of the original image, and a charger 7 for uniformly charging the surface of the photoconductive drum 2 after the de-electrification. A developing apparatus 8 according to the invention for selectively applying a developing agent to the electrostatic latent image, on the surface of the photoconductive drum 2, thereby developing the electrostatic latent image. Thus, the developing apparatus 8 forms a visible image on the surface of the photoconductive drum 2.

A paper feeding section 10 is provided at one side portion (e.g., the right-hand side portion of FIG. 1) of the housing 1. The paper feeding section 10 includes a paper cassette 11 removably attached to the one side portion of the housing 1, a paper supply roller 12 in rolling contact with the uppermost one of sheets P contained in the paper cassette 11 and capable of delivering the sheets P one by one into the housing 1, and a sheet-bypass guide 13 for manual paper supply. Each sheet P delivered from the paper feeding section 10 is regulated for feed timing by a pair of aligning rollers 15, and fed so as to be in rolling contact with the photoconductive drum 2 in a transfer section.

The photoconductive drum 2 is also surrounded by a transfer charger 16 for transferring the developing agent to the sheet to form a visible image thereon, and a separation charger 17 for separating the sheet from the photoconductive drum 2 after transfer. The transfer section is defined between the photoconductive drum 2 and the transfer charger 16. After the developing agent image (visible image) is transferred to the sheet, the sheet is guided to a fixing unit 20 by a conveyor belt 19. The developing agent is fixed by the pressure and heat of a pair of heat rollers 21 which constitute the fixing unit 20. After the fixation, the sheet is discharged onto a tray 23 by a pair of exit rollers 22. After the transfer operation, the developing agent remaining on the surface of the photoconductive drum 2 is removed by a cleaning unit 18.

Figure 2:
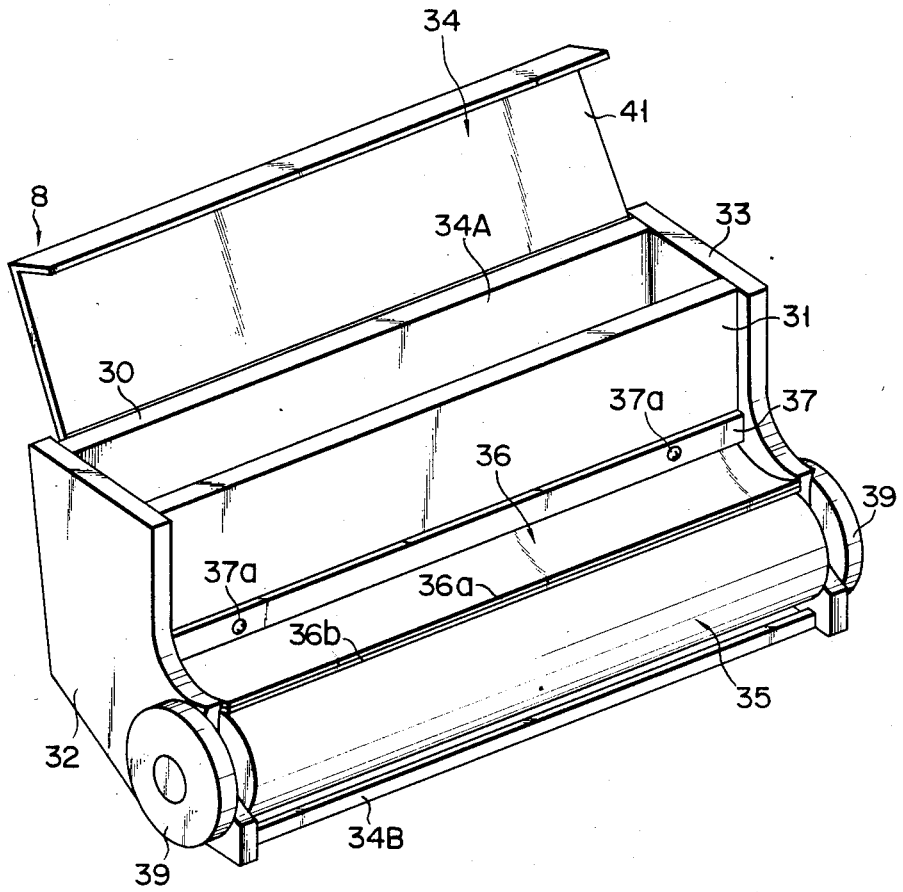
FIG. 2 is a perspective view schematically showing a developing apparatus according to one embodiment of the present invention.
Figure 3:
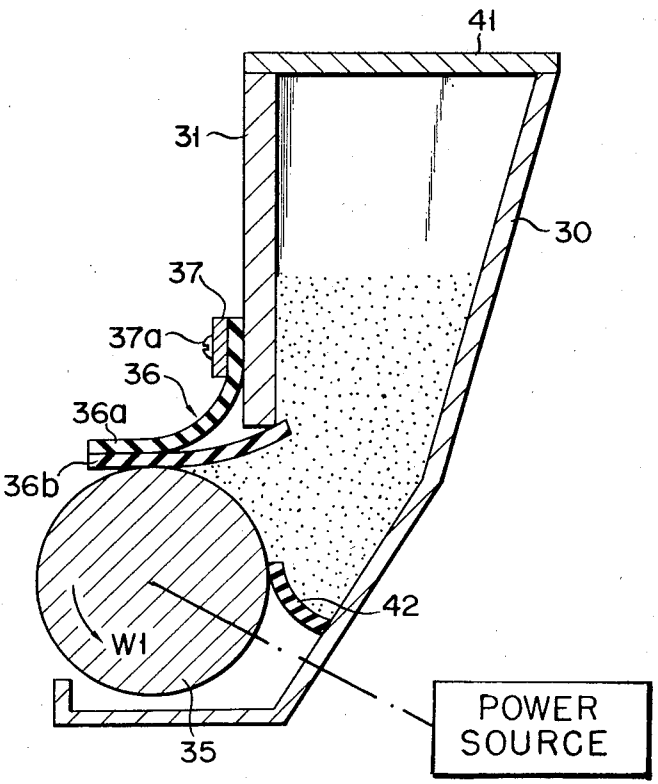
FIG. 3 is a sectional view schematically showing the developing apparatus of FIG. 2.

The developing apparatus 8 according to the first embodiment of the invention will be described in detail. FIGS. 2 and 3 are a perspective view and a sectional view, respectively, schematically showing the developing apparatus 8.

The developing apparatus 8 has a housing 34 which contains a nonmagnetic developing agent. The housing 34 is provided with a back frame 30 and a front frame 31 spaced from each other and side frames 32 and 33 attached to both side portions of the frames 30 and 31. The housing 34 is open at both the top and bottom and has a swingable cover member 41 at its top opening 34A. When the cover 41 is up, the developing agent is supplied through the top opening 34A. Disposed near a bottom opening 34B of the housing 34 is a rotatable developing agent carrier, e.g., an aluminum or stainless-steel developing roller 35, which carries the developing agent on its surface. The developing roller 35 is pivotally mounted on the two side frames 32 and 33.

A recovery blade 42 is arranged on the inner surface of the back frame 30. In the housing 34 of the developing apparatus, a stirrer 43 is pivotally arranged to stir the developing agent T. Furthermore, the leading end portion of the front frame 31 extends to a position near the developing roller 35 and serves as a developing agent regulating member 44, as will be described later.

The front frame 31 is fitted with an elastic blade 36 by means of a blade holder 37. The elastic blade 36 comprises two elastic plates **36*a* and 36*b* which are formed of, e.g., silicone-butadiene rubber (40 to 90 hardness), urethane rubber, stainless steel, phosphor bronze (approximately 0.01 to 0.5 mm in thickness), or urethane sheet. The two elastic plates 36*a* and 36*b* are adhered to each other to have an adhesive width of 5 mm or less so that one end of each thereof overlaps the other. The upper elastic plate 36*a* then serves as a fixed plate and the lower elastic plate 36*b* serves as a contact plate. The other end of the fixed plate 36*a* is fixed to the front frame 31 through a blade holder 37 with bolts 37*a* such that the undersurface of the contact plate 36*b* is pressed against the surface of the developing roller 35 under the prescribed pressure to coat the surface with the developing agent T. Note that the other end of the contact plate 36*b* is engaged with a lower end of the front frame 31. The contact pressure between the elastic blade 36 and the developing roller 35 can be finely adjusted by controlling the position of the blade holder 37**.

Part of the surface of the elastic blade 36 opposed to the developing roller 35 is in surface contact with the developing roller 35. Due to this construction, the contact area between the elastic blade 36 and the developing roller 35 is wider than in the case of the prior art construction in which merely the free end portion of the elastic blade is pressed against the developing roller. This construction faciliates the fine adjustment of the contact pressure on the developing roller 35 and allows the contact pressure to be made uniform. Also, the developing agent can enjoy friction under the contact pressure for a longer time, thus acquiring uniform and sufficient electric charges.

The developing apparatus 8 is located in a position such that the developing agent layer on the developing roller 35 is not in physical contact with the photoconductive drum 2. A gap G is allowed between the developing roller 35 and the photoconductive drum 2 which depends on the particle size of the developing agent and the thickness of the developing agent layer. To ensure the transfer of the developing agent for a visible image of good quality, it is necessary to minimize the gap G. However, the gap G can be narrowed only if the developing agent layer on the developing roller 35 is a relatively thin layer. Also the resolution of the desired image depends on range of the particle size of the developing agent used. Thus, the gap G between the developing roller 35 and the photoconductive drum 2 ranges (as a practical matter) from approximately 50 to 400 microns. Here the thin layer may be a monolayer or a multilayer, including up to six or seven layers, of the developing agent.

To maintain the accuracy of the gap G, a pair of gap control rollers 39 are mounted on the shaft of the developing roller 35 so as to be rotatable with the drum. The gap control rollers 39 come into contact with both side portions of the peripheral surface of the photoconductive drum 2 or engaging rollers (not shown) mounted on the shaft of the photoconductive drum 2, thereby keeping the intercentral distance between the photoconductive drum 2 and the developing roller 35 constant. A power source 40 is also provided for applying a voltage to the developing roller 35 to form an electric field between the photoconductive drum 2 and the developing roller 35 and generally includes D.C. power source or deviated A.C. power source. The power source 40, which is not requisite for the developing apparatus 8 of the invention, serves to facilitate the transfer of the developing agent on the developing roller 35 to the surface of the photoconductive drum 2 by forming an electric field between the two members 2 and 35. The developing agent frictionally charged on the developing roller 35 is transferred to the surface of the photoconductive drum 2 by an electrostatic attraction attributed to latent image charges on the surface of the photoconductive drum 2.

The operation and effect of the above developing apparatus will be described below.

The developing apparatus 8 is filled with the developing agent T. The developing roller 35 is rotated along a direction indicated by an arrow W1 in FIG. 3. Upon rotation of the developing roller 35, the developing agent T is conveyed from the housing 34 along the direction indicated by the arrow W1 by the rotational force, weight of the developing agent and mutual friction. In this manner, the developing agent T is supplied under a contact pressure between the contact plate **36*b* and the developing roller 35. On the other hand, since the portion of the contact plate 36*b* near the portion adhered to the fixed plate 36*a* (36*a* and 36*b* together constituting the elastic blade 36) is pressed against the developing roller 35, the contact plate 36*b* is brought into contact with the developing roller 35 in a relatively large contact width. Therefore, the developing agent T which is supplied under contact pressure between the elastic blade 36 and the developing roller 35, is charged by friction to a desired potential when it passes through under this contact pressure. In addition, a uniformly thin layer of the developing agent T is formed on the surface of the developing roller 35. The thin layer of the developing agent T is conveyed to a point opposite the photoconductive, drum 2 upon rotation of the developing roller 35. At this point, the developing agent T receives electrostatic power from the photoconductive drum 2. Therefore, the developing agent particles, subjected to the attractive force of the photoconductive drum 2 (which is larger than that of the developing roller 35), are sequentially applied across the gap G and attached to the photoconductive drum 2 in accordance with a latent image potential thereof, thus visualizing (developing) the latent image. The developing agent which is not applied to the drum 2 and retained on the developing roller 35, is conveyed by the developing roller 35 to a developing agent recovery blade 42, where it is recovered to the developing apparatus 8 from the developing roller 35**.

According to this embodiment, the elastic blade 36 comprises the fixed plate and contact plate consisting of the two elastic plates 36*a* and 36*b*, and the contact plate 36*b* is pressed against the developing roller 35. Also, the contact width between the contact plate 36*b* and the developing roller 35 can be easily set to be large in accordance with the contact pressure. For this reason, the developing agent can be subjected to friction under the contact pressure for a longer time, and can therefore be more uniformly charged. In addition to this, the developing agent can be attached to the developing roller 35 as a thinner layer. Therefore, the developing agent can easily cross the gap G between the developing roller 35 and the photoconductive drum 2 and good image formation can be achieved. Even when the diameter of the developing roller 35 is decreased, since the contact width can be set to be large as described above, the developing apparatus 8 itself can become more compact in size.

Figure 4:
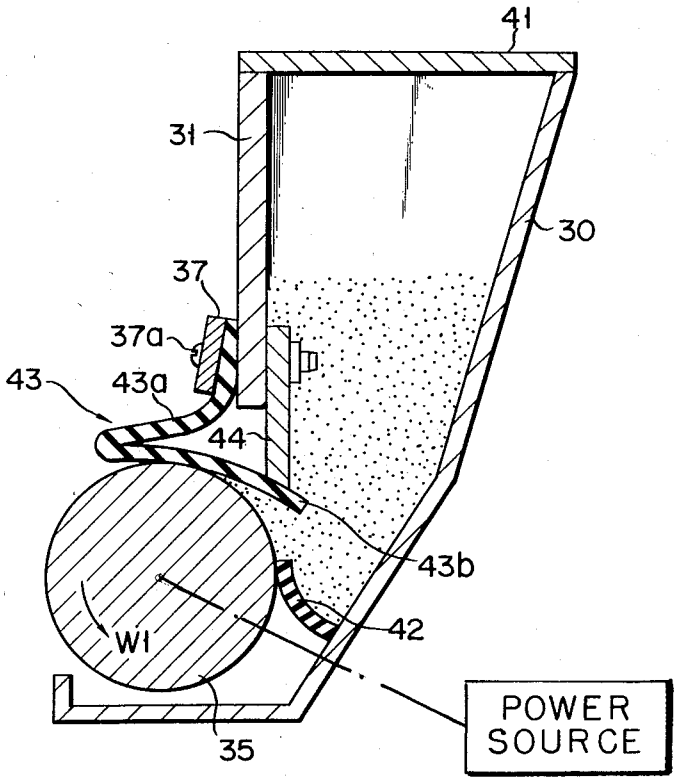
FIG. 4 is a sectional view schematically showing a developing apparatus of one modification according to the embodiment.

The present invention is not limited to the above embodiment. FIG. 4 shows a modification of the above embodiment. As shown in FIG. 4, the elastic blade according to the modification comprises a single elastic plate 43 formed of the same material as those of the fixed plate and contact plate 36*a* and 36*b* of the above embodiment. The elastic plate 43 is bent at a substantially central portion thereof, as shown in FIG. 4, and upper and lower portions 43*a* and 43*b* respectively serve as the fixed plates and contact plates 36*a* and 36*b*. In the elastic plate 43 having such a structure, a leading edge of the upper portion 43*a* is mounted on the front frame 31 and a central portion of the lower portion 43*b* is pressed against the developing roller 35. A leading edge of the lower portion 43*b* is pressed toward the developing roller 35 by a supporting member 44 which is mounted on the front frame 31. In the modification of this construction, a portion near the bent portion of the elastic plate 43 is pressed against the developing roller 35, thereby easily increasing the contact width in the same manner as in the above embodiment of FIG. 3.

As described above, according to the present invention, a developing apparatus can be provided in which even when a developing agent carrier having a small diameter is used, a contact width between an elastic blade and the developing agent carrier can be set to be large and a developing agent can be charged at a desired potential, thereby performing satisfactory developing.

What is claimed is:

1. A developing apparatus for use in developing a latent image within a photocopying machine comprising:

developing agent carrier means for carrying a developing agent thereon;

housing means for housing said developing agent therein and supplying said developing agent to said developing agent carrier means; and elastic member means for pressing against the surface of said developing agent carrier means to apply the developing agent thereto, so that said developing agent is applied to said surface of said developing agent carrier means by said elastic member means and for forming a layer of said developing agent on said surface of said developing agent carrier means;

wherein said elastic member means comprises a fixed plate and a contact plate which are both constructed of elastic material, and are fixed to each other at one end thereof, the other end of said fixed plate being fixed to said housing means, and a central portion of said contact plate being pressed against the surface of said developing agent carrier means.

2. The developing apparatus according to claim 1, wherein said fixed plate and said contact plate are respectively formed of independent elastic plates, and are adhered to each other at one end thereof.

3. The developing apparatus according to claim 2, wherein a portion of said contact plate near the adhered portion thereof with said fixed plate is pressed against the surface of said developing agent carrier.

4. The developing apparatus according to claim 1, wherein said fixed plate and said contact plate respectively comprise one bent piece and the other bent piece of a single elastic plate, said developing apparatus formed by bending said single elastic plate at a substantially central portion thereof.

5. The developing apparatus according to claim 4, wherein a portion of said contact plate near said bent portion thereof is pressed against the surface of said developing agent carrier.

6. The developing apparatus according to claim 4, which further comprises a supporting member which is mounted on said housing and biases a leading edge of said contact plate toward said developing agent carrier.

7. A developing apparatus as in claim 1 further comprising:

image bearing member means, opposed to said layer and separated by a predetermined space therefrom, for having said developing agent deposited as a latent image thereupon.

8. A developing apparatus as in claim 7 further comprising developing agent which is of the non-magnetic type.

* * * * *